United States Patent [19]

Enkegaard

[11] Patent Number: 4,715,188

[45] Date of Patent: Dec. 29, 1987

[54] METHOD AND COOLER FOR COOLING GRANULAR MATERIAL

[75] Inventor: Torben Enkegaard, Copenhagen, Denmark

[73] Assignee: F. L. Smidth & Co. A/S, Copenhagen, Denmark

[21] Appl. No.: 876,243

[22] Filed: Jun. 19, 1986

[30] Foreign Application Priority Data

Jun. 28, 1985 [GB] United Kingdom ..... 8516474

[51] Int. Cl.[4] ..... F25D 13/06

[52] U.S. Cl. ..... 62/63; 34/57 B; 34/67 B

[58] Field of Search ..... 62/63; 432/78; 34/57 B, 34/67 B, 62

[56] References Cited

U.S. PATENT DOCUMENTS 2,904,323 9/1959 Cova et al. ..... 34/57 B

FOREIGN PATENT DOCUMENTS 51-21400 7/1976 Japan ..... 432/78

530836 2/1974 U.S.S.R. ..... 34/57 B

*Primary Examiner*—Henry A. Bennet

*Attorney, Agent, or Firm*—Brumbaugh, Graves, Donohue & Raymond

[57] ABSTRACT

A clinker cooler has a stationary tubular body (4) with a material inlet (3) connected to a kiln (1) and a material outlet (5). Material (18) is repeatedly raised into the path of cooling air from a fan (7) by blasts of air from a row of blasters (8).

5 Claims, 2 Drawing Figures

METHOD AND COOLER FOR COOLING GRANULAR MATERIAL

Figure 1:
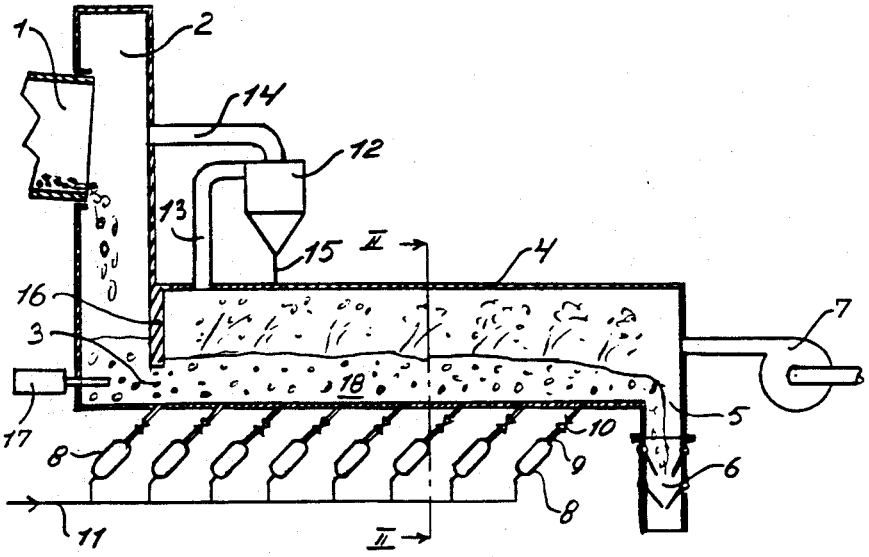

The invention relates to a method, hereinafter referred to as of the kind described, of cooling granular material, such as cement clinker, in a horizontal or inclined, tubular cooler having a material inlet end connected to the material outlet end of a kiln, in which the material has been heat treated, and a material outlet end connected to a cooling air source, which blows cooling air through the cooler for cooling the material, the material being repeatedly dispersed and suspended inside the cooler.

By a horizontal or inclined cooler is to be understood that a longitudinal axis of the tubular cooler is horizontal or inclined downwards in the direction towards the material outlet end of the cooler so as to ensure a material conveying velocity through the cooler suitable for adequate cooling of the material.

Coolers of the above kind are often designed as a rotating drum which, via live rings mounted on the circumference of the drum, is supported by roller supports and which, via a gear rim, is driven by a pinion connected to a motor. The material is agitated by the rotation of the drum, and cooled by air blown countercurrently to the movement of the material through the drum by a fan mounted at the outlet end of the cooler.

The cooling air from the cooler may, after possible dedusting, be used as secondary air for the combustion in the kiln for the heat treatment of the material.

To increase the area of the material surface in contact with the cooling air the rotating drum is often provided with lifters for lifting the material from the bottom of the drum, the material then cascading down again through the flow of cooling air.

However, in order not to damage and crush the lining of the drum it is necessary to ensure that the material falling from the lifters lands on the material charge at the bottom of the drum. This means that the falling material only occupies approximately half the drum cross-section so that less than the entire cross-sectional area is utilized for the cooling. Further the cooling air tends to pass through those parts of the cross-section which are free of falling material, resulting in an inferior cooling effect.

It is the object of the invention to improve the cooling of the material and further to provide for the possibility of making the cooler more simple and reliable than the known rotating drum coolers.

This is achieved by a method of the kind described, characterized in that the cooler is stationary, and in that the dispersion and suspension are effected by intermittent shock air blasts through the material charge in the cooler.

By means of these shock air blasts, parts or particles of the charge are lifted up into the space above the material charge proper and spread across the entire cross-sectional area of the cooler, the lifted and suspended material being effectively blown through and cooled by the cooling air.

The invention also includes a cooler for use in carrying out the new method, the cooler having a horizontal or inclined, tubular body with a material inlet end and a material outlet end for connection to a source of a flow of cooling air; characterized in that the tubular body is non-rotatable and has at least one row of shock air blasters mounted along the bottom of the cooler body, the air outlets of the blasters projecting up through the bottom of the cooler body and being directed, in use, against the material charge in the cooler body.

By such a method and cooler the hitherto used roller supports and drive means for rotating the drum can be omitted and the stationary cooler does not require a circular cross-section as in case of the rotating cooler. On the contrary, the cross-section of the stationary cooler can be designed so as to ensure that the material suspended by means of the shock air blasts in spread across the entire cooler cross-section.

It has been found that the amount of air for the shock air blasts needs only to be a few percent of the total amount of air necessary for cooling the material.

Such shock air blasters are known and used e.g. for breaking down material bridging in, or sticking to, the sides of e.g. a silo hopper outlet. A shock air blaster proper is often a pressure vessel which is charged from a compressed air source and intermittently discharged momentarily through an outlet duct having a comparatively large diameter and thereby providing for a shock wave out from the duct. The duct is opened and closed by a valve which may be adjusted to release a shock air blast each time the pressure in the vessel has increased to a certain value, or the valve may be so controlled that a plurality of shock air blasters may be released intermittantly according to a preselected order.

The outlets of the shock air blasters along the bottom of the cooler may expediently be directed obliquely upwards and forwards in the direction towards the cooler material outlet whereby the shock air blasts also assist the material in the cooler in moving it towards the material outlet of the cooler, which in connection with a possible inclination of the cooler provides for a better material conveyance through the cooler.

Figure 2:
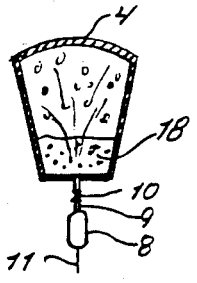

The invention will now be explained in more detail, with reference to the accompanying diagrammatic drawings, in which:

FIG. 1 is an axial section of an example of a cooler according to the invention; and, FIG. 2 is a section taken on the line II—II in FIG. 1.

A material outlet end 1 of a rotary kiln for producing clinker is provided with a material outlet (and air inlet) chamber 2 leading down to a material inlet end 3 of a stationary cooler 4 for cooling the clinker manufactured in the rotary kiln 1.

In an outlet end 5 of the cooler 4 is, in known manner, mounted a sluice arrangement 6 and in this end is also provided an inlet for a fan 7 for blowing cooling air through the cooler.

Beneath the cooler bottom is mounted a row of shock air blasters 8 each of which is equipped with an outlet duct 9 having a comparatively large cross-section, and which can be opened and closed by means of a valve 10 which is often built-in in a compressed air vessel proper of the blaster 8.

Each outlet duct 9 projects through the cooler bottom and is directed against a material charge 18 at the bottom of the cooler. The shock air blasters 8 are further connected to a common compressed air pipe 11.

The function of a shock air blaster is described above and is known per se.

As illustrated in the drawing the outlet ducts 9 of the shock air blasters are further directed obliquely forwards in the direction of the cooler outlet end 5.

The cooler may be provided with a cyclone 12 for separating the dust from the cooling air before the latter is utilized in the kiln. The cyclone 12 has an air inlet pipe 13 connected to the cooler 4 and an air outlet pipe 14 connected to the outlet chamber 2. The outlet 15 of the cyclone 12 for precipitated material is connected to the cooler 4. To force the cooling air through the precipitation cyclone 12 the inner space of the cooler 4 may be separated from the outlet chamber 2 by a partition wall 16 projecting down into the material charge at the bottom of the cooler.

At the bottom of the outlet chamber 2 may be mounted in a known way, an hydraulic poker 17 for breaking down material forming bridges or baking into lumps at the bottom of the outlet chamber 2.

The cooler operates in the following way: Material which has been heat treated in the kiln 1 falls onto the bottom of the outlet chamber 2 and moves henceforward into the cooler 4 proper and further on along the bottom towards the cooler outlet 5. Cooling air is, by means of the fan 7, blown in the opposite direction through the cooler 4.

The material charge 3 at the bottom of the cooler 4 is aerated by shock air blasts from the shock air blasters 8 whereby parts of the material are flung up into the space above the material charge, thus forming a large surface for effective cooling by the cooling air passing through the cooler.

The shock air blasters are operated intermittently either according to a controlled definite order or simply in that the valve 10 of the individual blaster opens when the pressure in the shock air blaster in question has reached a certain level.

The heated cooling air from the fan 7, having collected material dust during its passage through the cooler 4, is discharged from the cooler through the duct 13 to the cyclone 12 which separates the material dust from the cooling air. The dust is, via the material outlet 15, returned to the cooler, while the cleaned cooling air is introduced into the outlet chamber 2 via the duct 14 to be utilized as secondary combustion air in the kiln 1.

If the material being cooled gives off only a negligible amount of dust to the cooling air the cyclone 12 and its appertaining pipe connections 13, 14 and 15 can be omitted. Consequently, also the partition wall 16 can be deleted, thus permitting the cooling air to flow directly from the cooler via the outlet chamber 2 to the kiln 1.

I claim:

1. A cooler for cooling granular material, said cooler comprising a horizontal or inclined non-rotatable cooler body having a material inlet end and a material outlet end, a cooling air source for providing cooling air through said cooler in a direction from said material outlet end toward said material inlet end, at least one row of shock air blasters mounted along the bottom of said cooler body, said shock air blasters having air outlets projecting upwardly through said bottom of said cooler body so as, in use, to direct air blasts against said material and cause said material to be dispersed and suspended in said cooler.

2. A cooler according to claim 1 wherein said outlets of said shock air blasters are directed obliquely upwards and forwards in the direction towards said material outlet end of said cooler body.

3. A method of cooling granular material in a horizontal or inclined tubular cooler having a material inlet end connected to a material outlet end of a kiln, in which said material has been heat treated, and a material outlet end connected to a cooling air source, which blows cooling air through said cooler for cooling said material, comprising the steps of feeding said material from the material outlet end of said kiln into said material inlet end of said cooler, causing said material to be advanced from said cooler material inlet end to said cooler material outlet end at least in part by causing the cooler to be inclined downwardly toward the cooler material outlet end while maintaining said cooler non-rotatable, repeatedly dispersing and suspending said material inside the cooler by directing intermittent shock air blasts upwardly through said material, and subjecting said dispersed and suspended material to a flow of air from said cooling air source countercurrent to the direction of the material advancing through the cooler.

4. A method of cooling granular material in a horizontal or inclined tubular cooler having a material inlet end connected to a material outlet end of a kiln, in which said material has been heat treated, and a material outlet end connected to a cooling air source, which blows cooling air through said cooler for cooling said material, comprising the steps of feeding said material from the material outlet end of said kiln into said material inlet end of said cooler, causing said material to be advanced from said cooler material inlet end to said cooler material outlet end while maintaining said cooler non-rotatable, repeatedly dispersing and suspending said material inside the cooler by directing intermittent shock air blasts upwardly through said material, said material being caused to be advanced through the cooler at least in part by directing the shock air blasts obliquely upwardly and forwardly towards said cooler material outlet end, and subjecting said dispersed and suspended material to a flow of air from said cooling air source countercurrent to the direction of the material advancing through the cooler.

5. A method according to claim 3 wherein the material is caused to be advanced through the cooler at least in part by directing the shock air blasts obliquely upwardly and forwardly towards said cooler material outlet end.

* * * * *